United States Patent [19]

Werner

[11] Patent Number: 4,785,643

[45] Date of Patent: Nov. 22, 1988

[54] BASKET ACCESS FOR AUTOMATIC WASHER

[75] Inventor: Kurt Werner, St. Joseph, Mich.

[73] Assignee: Whirlpool Corporation, Benton Harbor, Mich.

[21] Appl. No.: 939,150

[22] Filed: Dec. 8, 1986

[51] Int. Cl.[4] ..... D06F 37/24

[52] U.S. Cl. ..... 68/3 R; 68/210; 312/319

[58] Field of Search ..... 312/26, 319; 68/3 R, 68/210; 134/200, 134, 143

[56] References Cited

U.S. PATENT DOCUMENTS

| | | | |
|---|---|---|---|
| 560,904 | 5/1896 | Kufs | 134/134 |
| 1,485,797 | 3/1924 | Merseles | 68/210 X |
| 1,549,027 | 8/1925 | Perry | 68/210 |
| 2,147,302 | 2/1939 | Lang | 68/210 |
| 3,116,903 | 1/1964 | Grantham | 68/210 X |
| 3,132,098 | 5/1964 | Bochan | 68/23.3 |
| 3,269,790 | 8/1966 | Cushing | 134/143 |
| 4,174,622 | 11/1979 | Bunnell et al. . | |
| 4,370,992 | 2/1983 | Choudhury et al. | 134/134 X |
| 4,526,020 | 7/1985 | Fey et al. . | |
| 4,531,387 | 7/1985 | Cotton et al. . | |
| 4,535,610 | 8/1985 | Fey et al. . | |

FOREIGN PATENT DOCUMENTS

| | | | |
|---|---|---|---|
| 2522116 | 11/1976 | Fed. Rep. of Germany | 68/210 |
| 693368 | 8/1965 | Italy . | |

*Primary Examiner*—Harvey C. Hornsby
*Assistant Examiner*—Frankie L. Stinson
*Attorney, Agent, or Firm*—Lowe, Price, LeBlanc, Becker & Shur

[57] ABSTRACT

In a combination appliance comprising a dryer mounted above an automatic washer wherein access to the basket of the washer is limited, the basket of the washer tilts forward automatically to improve access as the lid is opened by the user. The basket is located within a tub that in turn is mounted on a resiliently supported frame. A cable connected between the lid and a lower portion of the rear of the tub is maintained in tension by a pulley that is spring-mounted to the interior of the cabinet. As the lid is opened, the cable is pulled along the pulley to tilt the basket forward on the resiliently supported frame for improved access by the user to the interior of the basket.

30 Claims, 3 Drawing Sheets

BASKET ACCESS FOR AUTOMATIC WASHER

FIELD OF THE INVENTION

This invention relates generally to apparatus for providing improved access to the basket of an automatic washer, and more particularly toward an apparatus for tilting the basket of an automatic washer forward for improved access as the lid of the washer is manually opened by a user. The invention has particular utility in a vertical washer and dryer combination appliance wherein access to the basket of the washer is obstructed somewhat by the top mounted dryer.

DESCRIPTION OF THE PRIOR ART

Access to the basket of an automatic washer is generally easy when the user has unimpeded access to the top of the unit. However, for efficient utilization of limited space, as is the case in confined residential quarters such as small apartments and condominiums, it is convenient to locate a compact dryer directly above the automatic washer. This, unfortunately, tends to limit access by the user to the inside of the basket of the washer, making it difficult to load the basket evenly and empty the basket. Different approaches to improve access to the basket have been taken in the past, but none are completely satisfactory.

In U.S. Pat. No. 4,531,387 to Cotton et al, for example, a sliding access door in the cover of the washer portion of a combination washer and dryer appliance is manually operable between a rear, open position beneath the dryer and a forward, closed position to enclose the basket. Although this approach improves access to the basket, since there is no pivoting lid the opening of which otherwise be obstructed somewhat by the dryer, the sliding access door does not improve the extent to which the user can view the contents of the basket.

U.S. Pat. Nos. 4,526,020 and 4,535,610 to Fey et al disclose a washer and dryer combination wherein the entire cabinet of an automatic washer including the tub and basket are pivoted on a support at floor level to enable the basket to be accessible to a user. To prevent pivoting of the washer when the tub is full of water, a relatively complex latch maintains the cabinet horizontal in response to the output of a water level detector within the tub.

Italian Patent No. 693368 discloses a system wherein the tub and basket of a front loaded automatic washer are pivoted to access the basket. Like the Fey et al system, the tub must be emptied of water before the basket is accessed because when the tub is pivoted, the center of gravity of the washer shifts too far forward to enable the washer to be easily manually pivoted back to its normal position.

It is accordingly one object of the invention to improve access to the basket of an automatic washer.

Another object is to provide an apparatus for improving access to the basket of an automatic washer without modifying the cabinet of the washer or increasing the amount of floor space required.

An additional object is to provide an apparatus to tilt the basket of an automatic washer forward automatically as the lid is opened to improve access to the basket by the user.

A further object of the invention is to provide a means to improve access to the basket of the washer component of a combination washer and dryer appliance of a type wherein the dryer, mounted above the washer, tends to restrict access to said basket.

SUMMARY OF THE INVENTION

In an automatic washer comprising a cabinet containing a tub, a basket within the tub beneath a lid of the cabinet for receiving wash and an agitator for agitating the wash, the tub is mounted on a resiliently supported frame and is coupled to the lid to tilt forward on the frame as the lid is manually opened. In accordance with a preferred embodiment, a cable is coupled between the lid and a lower rear portion of the tub so that as the lid is pivoted open, the rear portion of the tub is lifted somewhat, tilting the tub and basket forward below the lid. to guide the cable between the lid and tub, the cable is passed over a pulley mounted on the interior of the cabinet near the upper surface of the washer. The pulley is spring biased outward from the tub and lid to maintain the cable in tension.

Preferably, one end of the cable is pinned to the lower end of the rear of the tub and the opposite end is secured to a bracket that extends outward from the axis of rotation of the lid to pull the cable through an arc as the lid is opened. The bracket consists of an elongated arm having one end connected to the lid and an opposite, arcuate end formed with a peripheral recess to receive the cable.

Still other objects and advantages of the present invention will become readily apparent to those skilled in this art from the following detailed description, wherein only the preferred embodiment of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

DETAILED DESCRIPTION OF A PREFERRED EMBODIMENT

Figure 1:
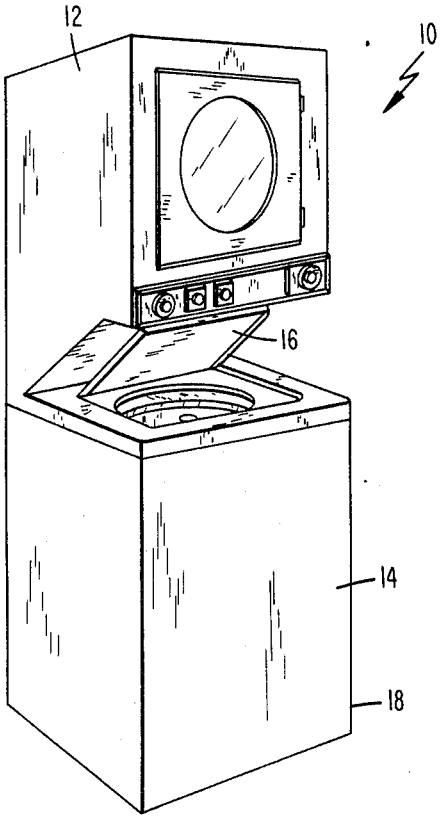
FIG. 1 is a perspective view of a typical vertical washer-dryer combination appliance to which the invention is applied.
Figure 2:
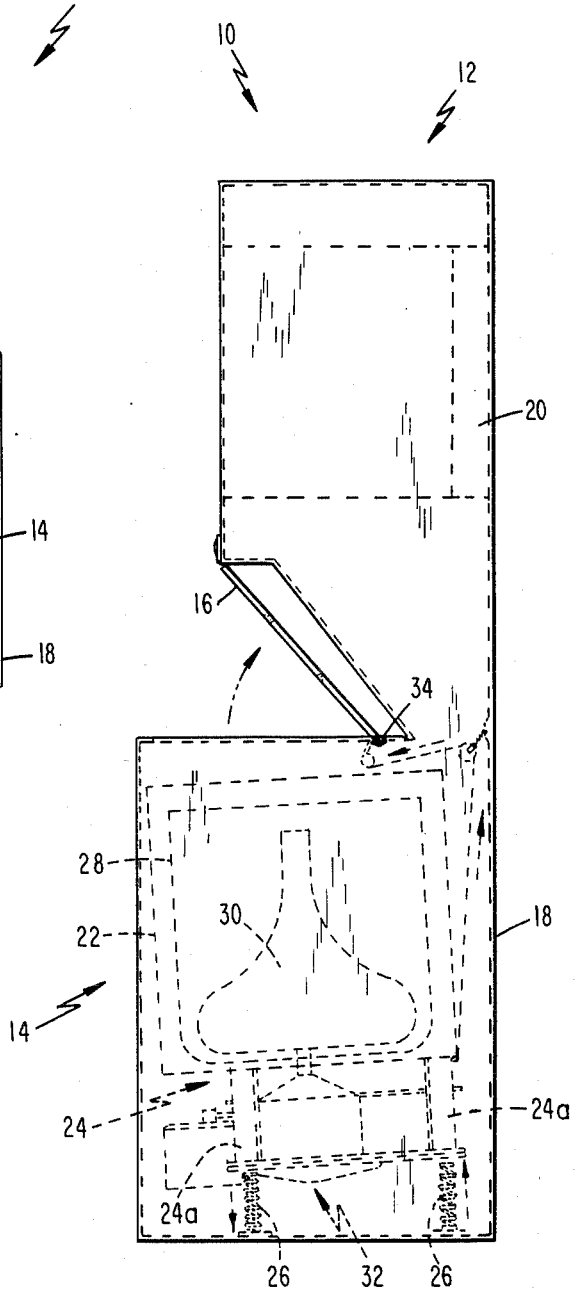
FIG. 2 is a side view of the appliance, with the tub and basket, shown in dotted lines, in a tilted position for access through the open lid.

Referring now to the drawings, and in particular to FIG. 1, a combination washer and dryer appliance 10 comprises a dryer 12 mounted above an automatic washer 14 and spaced from the upper surface of the washer by a distance sufficient to enable a lid 16 of the washer to be manually opened into the position shown in the figure. The automatic washer 14 is housed within a floor mounted cabinet 18; the dryer 12 is within a cabinet 20 that is stacked on the cabinet 18, and may be cantilevered from a pair of supporting wall brackets (not shown). The dryer cabinet 20 extends toward the front of the washer 14 above the lid 16, and as shown in FIGS. 1 and 2, establishes a region above the lid that is obstructed, i.e., the user cannot easily view the contents of the washer beneath the lid 16.

Within the cabinet 18 of automatic washer 14 there is a tub 22 (FIG. 2) mounted on a resiliently supported frame 24 that includes a set of legs 24*a* extending downward from the lower surface of the tub 22. Each leg 24*a* is on a helical spring 26 that is only partially compressed. As a consequence, the tub 22 "floats" somewhat on support frame 24 to yield to the shifting weight of the wash during a machine cycle. The tub 22 furthermore is able to tilt forward to improve access to the interior of the washer, as explained in detail hereinafter. Sufficient clearance between the tub 22 and cabinet 18 is provided to prevent any contact therebetween during such movements of the tub.

Within the tub is a basket 28 for retaining wash, and an agitator 30 is within the basket for agitating the wash. The agitator 30 is oscillated and tub 22 spun in accordance with washing and spin drying operations of a machine cycle by a motor and transmission assembly 32 mounted to bottom of the tub 22. Any preferred washing cycle control system, including fluid controlling and cycle controlling hydraulic and electrical means, will also be provided as is customary for automatic washers of this type. Details of a motor driven transmission assembly for utilization in this invention are given in U.S. Pat. No. 4,174,622 to Bunnell et al, assigned to the assignee of this invention and incorporated herein by reference.

Still referring to FIG. 2, with lid 16 hinged at 34 to the upper surface of the cabinet 18 as shown, the lid can be manually opened to position where at the upper end of the lid is immediately below the dryer 20. Because the proximity of the dryer cabined 20 above the washer makes it difficult for the user to have access to the region immediately over the basket 28, it is virtually impossible for the user to observe the contents of the basket near the front of the cabinet 18. In accordance with the invention, access to the basket is improved substantially by causing the tub 22 and basket 28 to tilt forward somewhat, into the position shown in dotted lines in FIG. 2, as the lid 16 is manually opened.

Figure 3B:
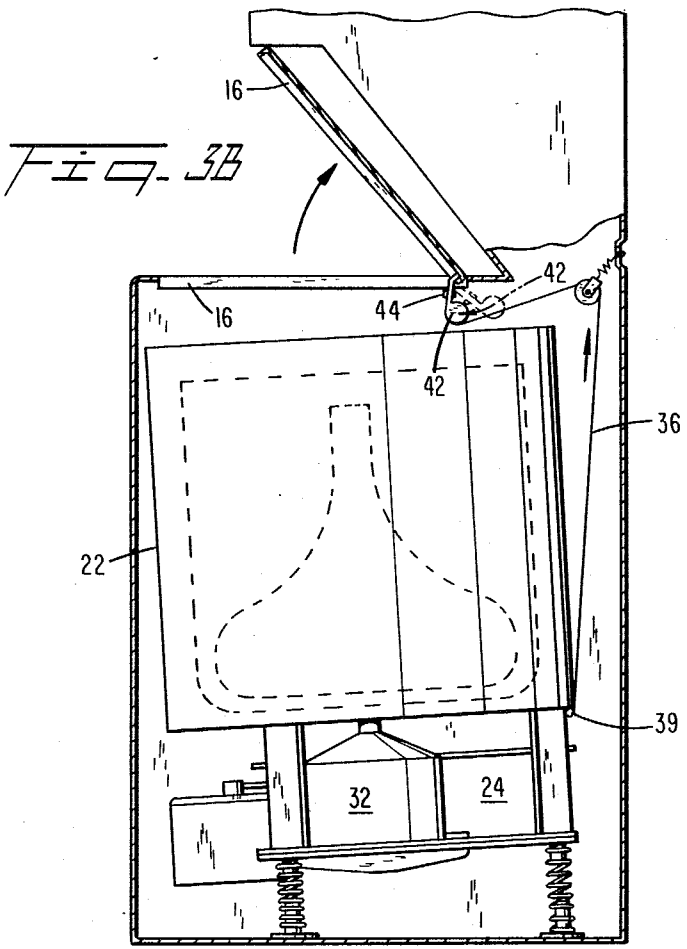
FIG. 3B is a cross-sectional side view corresponding to FIG. 3A, with the tub and basket tilted and lid open.
Figure 3A:
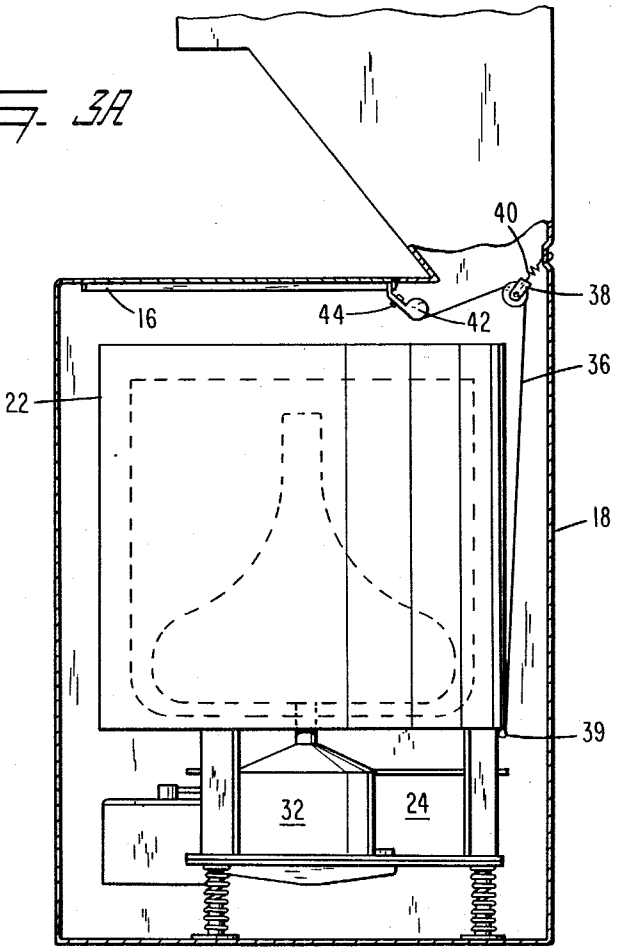
FIG. 3A is a cross-sectional side view of the appliance, with the tub and basket in a normal position on a vertical axis with the lid closed.

In accordance with the preferred embodiment, and with reference to FIGS. 3A and 3B, a cable 36 connected between a lower rear portion of tub 22 and the lid 16 is guided around the tub 22 by a pulley 38 mounted resiliently to cabinet 18 by a spring 40. A bracket 42, extending downward from a rear flange 16*a* of the lid 16, is connected to one end of the cable 36 at a bolt 44, as shown more clearly in FIG. 4. The bracket 42 is secured to the center of flange 16*a* by bolts 46 and extends radially from the axis of rotation A of the lid (FIG. 6) so as to move through an arc shown by the arrow in FIG. 3B as the lid is manually opened. With the opposite end of cable 36 attached to the lower end of tub 22 at pin 39, the tub tilts forward somewhat at the lower end of cable 36 is pulled upward by the motion of bracket 42, as shown in FIG. 3B. With the tub 22 and the motor transmission assembly 32 spring-mounted on legs 24*a*, the tub tilts by an amount sufficient to substantially improve access to the interior of basket 28 while avoiding contact between the tub 22 and cabinet 18 of the washer.

Figure 4:
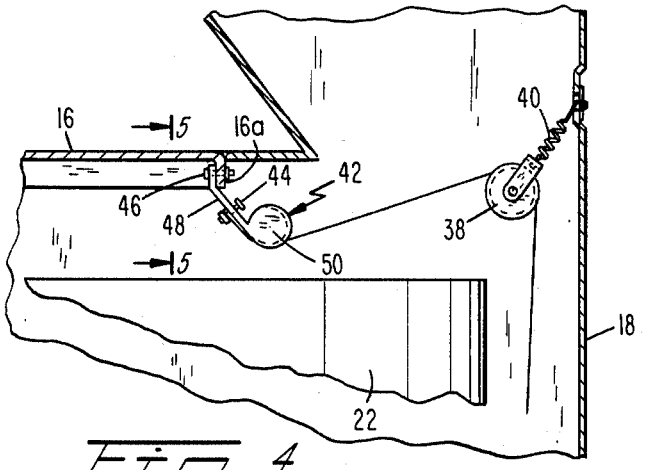
FIG. 4 is a cross-sectional view of a portion of the appliance more clearly showing the lid bracket and cable pulley for tilting the tub as the lid is opened.
Figure 5:
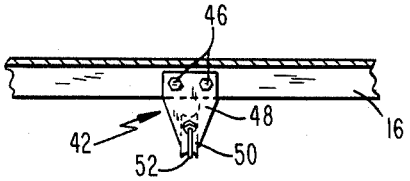
FIG. 5 is a rear view of a portion of the lid showing the construction of the lid bracket.

The bracket 42 comprises an elongated arm 48 extending from the lid 16 and an arcuate end portion 50, shown in FIGS. 4 and 5. The portion 50 is formed with a circumferential recess 52 (FIG. 5) to receive and retain the cable 36; tension is maintained on the cable 36 to retain the cable within the recess 52 by the spring 40 supporting pulley 38, as best shown in FIG. 4.

Figure 6:
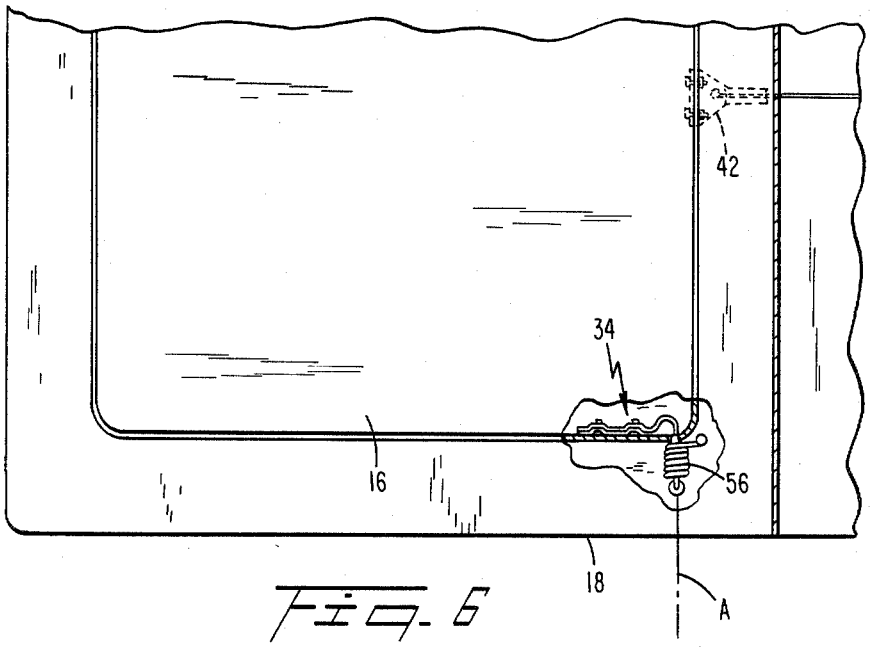
FIG. 6 is a top view of the washer showing the lid and one of its spring biased hinges.

The lid 16 is mounted to the top of cabinet 18 by a pair of hinges 34 (only one hinge is shown in FIG. 6). A helical spring 56 disposed on hinge 34 provides a predetermined bias tending to rotate lid 16 open. The force of spring 56 is insufficient to open the lid 16 against the resistance of cable 36, but is sufficient to maintain the lid open once the lid is manually opened by the user.

There has accordingly been described an automatic washer having a tub that is mounted on a resilient support and is coupled by a cable to the lid whereby, as the lid is opened manually, the tub tilts forward somewhat to improve access to the basket. While the degree of tilting in the invention is not as extensive as that provided in the Fey et al and Italian patents, supra, the small amount of tilting provided herein significantly improves accessibility by the user to the contents of the basket and also improves the ability of the user to view the wash throughout the interior of the basket. Tilting of the tub, stabilized by the resilient tub support in accordance with the invention, is accordingly safe and does not require the tub to have to be emptied of water to access the basket.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

What is claimed is:

1. In an automatic washer comprising a cabinet, a tub within said cabinet, a basket rotatably mounted in the tub for receiving wash and an agitator in said basket for agitating said wash, a lid in an upper surface of said cabinet above said basket and having a horizontal axis of rotation, and drive means for rotating selectively said agitator and said basket, an apparatus for tilting said tub upon opening of said lid by a user to provide improved access to said basket, comprising:

means for resiliently mounting said tub on a support surface within said cabinet; and a coupling means including a cable, means for securing one end of said cable to said lid and an opposite end of said cable to said tub and means for maintaining said cable in tension, said coupling means tilting said tub on said resilient mounting means in response to an opening of said lid.

2. The apparatus of claim 1, wherein said drive means is mounted to a lower surface of said tub for driving said basket and said agitator.

3. The apparatus of claim 1, wherein said opposite end of said cable is secured to a lower portion of said tub.

4. The apparatus of claim 3, wherein said coupling means further includes a bracket extending outward from said lid, and means for securing said one end of said cable to a portion of said bracket displaced from an axis of rotation of said lid.

5. The apparatus of claim 4, wherein said bracket is attached to a central portion of said lid adjacent said axis of rotation.

6. The apparatus of claim 4, wherein said bracket comprises an elongated arm having one end attached to said lid and an opposite end having an arcuate portion formed with a peripheral recess to receive said cable.

7. The apparatus of claim 1, including spring means for maintaining said lid open when said lid is manually opened by a user.

8. The apparatus of claim 1, wherein said tension-maintaining means comprises a pulley for receiving a portion of said cable, and spring means for resiliently mounting said pulley to an inner surface of said cabinet.

9. In a combination automatic washer and dryer comprising an automatic washer having a cabinet containing a tub, a basket within said tub for receiving wash and an agitator in said basket for agitating said wash, a lid pivotally mounted on a horizontal axis of rotation to an upper surface of said cabinet above said basket, and a dryer mounted above said cabinet in a position that provides clearance to the lid when pivoted open but obstructs full visual access by a user to the interior of the basket, an apparatus for tilting said tub upon opening of said lid by a user to provide improved access to said basket, comprising:

means for resiliently mounting said tub within said cabinet;

a coupling means; and means for connecting said coupling means between said tub and a portion of said lid to tilt said tub on said mounting means in response to an opening of said lid.

10. The apparatus of claim 9, including drive means mounted to a lower surface of said tub for driving said basket and said agitator.

11. The apparatus of claim 9, wherein said coupling means comprises a cable.

12. The apparatus of claim 11, wherein said coupling means includes means for securing one end of said cable to said lid and an opposite end of said cable to a lower portion of said tub.

13. The apparatus of claim 12, wherein said coupling means further includes a bracket extending outward from said lid, and means for securing said one end of said cable to a portion of said bracket displaced from an axis of rotation of said lid.

14. The apparatus of claim 13, wherein said bracket means is attached to a central portion of said lid adjacent said axis of rotation.

15. The apparatus of claim 13, wherein said bracket comprises an elongated arm having one end attached to said lid and an opposite end having an arcuate portion formed with a peripheral recess to receive said cable.

16. The apparatus of claim 12, including means for maintaining said cable in tension.

17. The apparatus of claim 16, wherein said tension-maintaining means comprises a pulley for receiving a portion of said cable, and spring means for resiliently supporting said pulley to an inner surface of said cabinet.

18. The apparatus of claim 9, including spring means for maintaining said lid open when said lid is manually opened by a user.

19. In an automatic washer comprising a cabinet, a tub mounted within said cabinet, a basket rotatably mounted in the tub for receiving wash and an agitator in said basket for agitating said wash, a lid in an upper surface of said cabinet above said basket and having a horizontal axis of rotation, and drive means for rotating selectively said agitator and said basket, an apparatus for tilting said tub upon opening of said lid by a user to provide improved access to said basket, comprising:

a coupling means including a cable, means for securing one end of said cable to said lid and an opposite end of said cable to a lower portion of said tub and means for maintaining said cable in tension to tilt said tub in response to an opening of said lid.

20. In an automatic washer comprising a cabinet, a tub within said cabinet, a basket rotatably mounted in the tub for receiving wash and an agitator in said basket for agitating said wash, a lid in an upper surface of said cabinet above said basket and having a horizontal axis of rotation, and drive means for rotating selectively said agitator and said basket, an apparatus for tilting said tub upon opening of said lid by a user to provide improved access to said basket, comprising:

means for resiliently mounting said tub on a support surface within said cabinet; and a coupling means including a cable, means for securing one end of said cable to said tub, a bracket extending outward from said lid and means for securing said one end of said cable to a portion of said bracket displaced from an axis of rotation of said lid, said bracket being attached to a central portion of said lid adjacent said axis of rotation, said coupling means tilting said tub on said resilient mounting means in response to an opening of said lid.

21. The apparatus of claim 20, including means for maintaining said cable in tension.

22. The apparatus of claim 21, wherein said tension-maintaining means comprises a pulley for receiving a portion of said cable, and spring means for resiliently mounting said pulley to an inner surface of said cabinet.

23. The apparatus of claim 20, wherein said drive means is mounted to a lower surface of said tub for driving said basket and said agitator.

24. The apparatus of claim 20, including means for maintaining said cable in tension.

25. The apparatus of claim 24, wherein said tension-maintaining means comprises a pulley for receiving a portion of said cable, and spring means for resiliently mounting said pulley to an inner surface of said cabinet.

26. The apparatus of claim 20, including spring means for maintaining said lid open when said lid is manually opened by a user.

27. The apparatus of claim 20, wherein said bracket is attached to a central portion of said lid adjacent said axis of rotation.

28. The apparatus of claim 20, wherein said bracket comprises an elongated arm having one end attached to said lid and an opposite end having an arcuate portion formed with a peripheral recess to receive said cable.

29. The apparatus of claim 20, wherein said opposite end of said cable is secured to a lower portion of said tub.

30. In an automatic washer comprising a cabinet, a tub within said cabinet, a basket rotatably mounted in the tub for receiving wash and an agitator in said basket for agitating said wash, a lid in an upper surface of said cabinet above said basket and having a horizontal axis of rotation, and drive means for rotating selectively said agitator and said basket, an apparatus for tilting said tub upon opening of said lid by a user to provide improved access to said basket, comprising:

means for mounting said tub on a support surface within said cabinet; and a coupling means including a cable, means for securing one end of said cable to said lid and an opposite end of said cable to a lower portion of said tub, a bracket extending outward from said lid and means for securing said one end of said cable to a portion of said bracket displaced from an axis of rotation of said lid, said bracket being attached to a central portion of said lid opposite said axis of rotation;

said coupling means tilting said tub in response to an opening of said lid.

* * * * *